United States Patent [19]

Iosifian et al.

[11] 4,284,927

[45] Aug. 18, 1981

[54] METHOD FOR BREAKING DIRECT CURRENT AND D.C. BREAKER FOR EFFECTING SAME

[76] Inventors: Andronik G. Iosifian, Bolshevistsky pereulok, 9, kv. 14; Vladilen P. Fotin, Gospitalny val, 3, korpus 5, kv. 140, both of Moscow; Vladimir N. Bondaletov, ulitsa Lenina, 9, kv. 45, Istra Moskovskoi oblasti; Evgeny I. Lapshin, ulitsa Bosova, 1, kv. 3, Istra Moskovskoi oblasti; Alexandr S. Ostrovsky, ulitsa Lenina, 9-a, kv. 72, Istra Moskovskoi oblasti; Alexandr I. Savchenko, ulitsa Pervomaiskaya, 10, kv. 22, Istra Moskovskoi oblasti, all of U.S.S.R.

[21] Appl. No.: 912,110

[22] Filed: Jun. 2, 1978

[30] Foreign Application Priority Data

Jun. 6, 1977 [SU] U.S.S.R. ..... 2493251

[51] Int. Cl.[3] ..... H01J 17/20

[52] U.S. Cl. ..... 315/340; 313/178; 315/108; 315/335

[58] Field of Search ..... 315/108, 109, 326, 335, 315/340; 313/174, 178, 179, 197, 198, 218, 223

[56] References Cited

U.S. PATENT DOCUMENTS

| | | | |
|---|---|---|---|
| 3,435,287 | 3/1969 | Jacobsen | 315/340 X |
| 3,480,822 | 11/1969 | Nastjukha et al. | 313/198 X |

OTHER PUBLICATIONS

Musin et al., *Electric Current in a Heterogenous Medium With Stationary and Movable Current Channels*, Journal of Technical Physics, vol. XLIII, No. 10, pp. 2075–2086.

Eliseyeu et al., *Some Properties of a Positive Column of Circular Cross-Section*, Journal of Technical Physics, vol. XLIII, No. 3, pp. 557–562.

*Primary Examiner*—Eugene La Roche

*Attorney, Agent, or Firm*—Haseltine and Lake

[57] ABSTRACT

A method for breaking direct current, whereby an initial gas pressure, corresponding to the working conditions of a stationary current channel, is set in a gas discharge device, whereafter direct current is passed through the gas discharge device, and the density of the gas filling said gas discharge device is simultaneously reduced over the entire volume of the gas discharge device to a critical value which causes a breaking of the direct current. The d.c. breaker for effecting this method is built around a gas discharge device comprising an anode, a cathode, and intermediate electrodes interposed between said anode and cathode. The cathode is formed by an end emitter, a cone-shaped reflector with the cone's apex facing the end emitter, and two coaxial cylinders encompassing the end emitter and reflector. The angle of inclination of the generatrix of the reflector's cone is selected so that the normal drawn at any point of the cone's lateral surface should cross the surface of the outer cylinder without crossing the surfaces of the inner cylinder and emitter.

2 Claims, 5 Drawing Figures

METHOD FOR BREAKING DIRECT CURRENT AND D.C. BREAKER FOR EFFECTING SAME

FIELD OF THE INVENTION

The present invention relates to switching means and, more specifically, to a method for breaking direct current and a d.c. breaker for effecting same.

The invention is used to break high-voltage current and is applicable to d.c. circuits and systems and surge current generators. The invention is further applicable to switching current in inductive power accumulators and other similar devices.

BACKGROUND OF THE INVENTION

There is known a method for breaking direct current, whereby at a moment of breaking direct current, an oscillatory discharge is superposed on the direct current. The oscillatory discharge is calculated so that the total current through the circuit should cross zero after a short period of time (cf. A. M. Zalessky, "Osnovy teorii electricheskikh apparatov"/"The Theoretical Principles of Electrical Apparatus"/, Moscow, 1974, p. 123). The device for effecting this method features an extremely complicated circuitry and high power consumption for its operation.

There are further known methods for breaking direct current, whereby direct current is passed through low-pressure gas discharge devices. According to one such method, there is brought about an increase in the negative potential at the grid of the gas discharge device, which, in turn, brings about a growth of the space charge layer in the small holes of the grid and a breaking of the direct current passed through the device. This method is feasible at a high level and high rates of increase in the return voltage, but it can only be used with currents of limited magnitudes because of great power losses at the grids (cf. A. I. Geren, V. A. Krestov, A. A. Nikolayev, "Moshchnye metallokeramicheskiye tasitrony"/"High-Power Metal-Ceramic Tacitrons"/, the Journal Radiotechnika, vol. 28, No. 3, 1973).

According to another method, direct current is passed through a gas discharge device, wherein the discharge is maintained by an external magnetic field which is either totally removed or has its intensity brought down below a critical value (cf. U.S. Pat. No. 3,678,289). In this case the permissible rate of increase in the return voltage is limited by the great period of deionization of the plasma gap, which may be as long as 100 to 1,000 microseconds. As a result, with an increase in the intensity of direct current to be broken and with an increase in the return voltage, the direct current breaking process may be disturbed as a certain discharge turns into an electric arc with a cathode spot.

There is still further known a method for breaking direct current, whereby direct current is passed through a low-pressure gas discharge device. At the same time the density of the gas filling the current channel of the gas discharge device is reduced to a critical value which causes a breaking of the direct current. For this purpose, a barrier is set across the path of the discharge inside the gas discharge device. The barrier is provided with holes to narrow the current channel. The density of gas is reduced in the narrow portion of the current channel by ions and electrons traveling at high speeds, which pass the direct current through the device and force neutral gas atoms to the area which is adjacent to the narrow portion of the current channel.

The plasma decay, which breaks the direct current, occurs only in the narrow portion of the current channel, whereas a state of conduction is maintained for some time in the area adjacent to the narrow portion of the current channel, so right after the breaking of the direct current, the conducting area may close and the discharge may turn into sustained current oscillation. Such a situation is all the more probable if direct current is broken under conditions of switching overvoltages. In addition, with an increase in the intensity of direct current to be broken, when the compression by the proper magnetic fields makes the diameter of the discharge channel less than that of its narrow portion, the method under review cannot be effected at all because the current channel moves at a high speed over the narrow portion and thus compensates for the decrease in the density of gas, caused by the passing current. As a result, the method under review is only effective with limited current and voltage levels; the permissible rate of increase in the voltage is limited by the great period of deionization of plasma in the area adjacent to the narrow portion of the current channel.

It is possible to break direct current in any known low-pressure gas discharge device if one can reduce in some way or other the density of gas inside the gas discharge device to a certain critical value which is dependent upon the nature of the gas and the configuration of the electrodes in the discharge zone of the device. However, such devices are only applicable to currents and voltages of limited magnitudes. Besides, the operating speed of such devices is limited because the decrease in the density of gas is accompanied by either a sharp increase in the voltage drop or by a rapid failure of the hot cathode, or by a growing probability of the formation of a cascade arc, or other undesired phenomena. For these reasons, users of such devices avoid great changes in the gas density and try to stabilize the gas conditions with the aid of a gas generator; in addition, the electrodes are manufactured from a material having a limited sorptive capacity with regard to the gas filling the gas discharge device.

There is known a switching means which can be used for breaking direct current and which is built around a gas discharge device. In said gas discharge device, the cathode is formed by an end emitter, a reflector arranged opposite the surface of the emitter, and two coaxial cylinders. Intermediate electrodes are interposed between the cathode and anode.

The cathode of the above design is such that a considerable amount of current passing through the device is shorted through the cold electrodes, whereas the discharge current is chiefly carried by ions formed due to ionization of neutral atoms by fast electrons oscillating between the surface of the hot cathode's emitter, the reflector and the coaxial cylinders.

In such a device, the cathode voltage drop is not varied by more than 20 percent with a more than 100-fold decrease in the density of gas; the passage of current is accompanied by an intensive absorption of gas by the reflector and the coaxial cylinders encompassing the hot cathode.

The device under review can be used for breaking direct current through decreasing the density of gas to a critical value; however, the magnitudes of currents to be broken are limited because the amount of current passing through the reflector increases and may amount to more than 80 percent of the total discharge current. In addition, a sharp rise in the temperature of the reflector and a reduced amount of current passing through the coaxial cylinders limit the rate of absorption of gas by the electrodes, wherefore it takes too much time or is totally impossible to reach a critical gas density.

SUMMARY OF THE INVENTION

It is an object of the present invention to provide a method for breaking direct current and a d.c. breaker for effecting this method, which would make it possible to break currents of several kiloamperes and hundreds of kilovolts.

It is another object of the invention to increase the operating speed of d.c. breakers.

The invention essentially consists in providing a method for breaking direct current, whereby direct current is passed through a gas discharge device, and the density of the gas filling the current channel of the gas discharge device is at the same time reduced to a critical value at which the direct current is broken, the method being characterized, according to the invention, by that prior to passing direct current through the gas discharge device, an initial gas pressure, corresponding to the working conditions of the stationary current channel, is set in the gas discharge device, and by that a reduction in the density of gas in the current channel is effected over the entire volume of the gas discharge device during the passage of direct current.

An improvement in the uniformity of distribution of current density over the section of the current channel, effected due to a decrease in the density of gas by performing the above sequence of operations, provides equal conditions for a plasma decay occurring at any point of the current channel. As a result, the plasma decay is accompanied by a restoration of the electric strength of the gas discharge gap, which process is completed as current is reduced to zero.

The invention further consists in providing a d.c. breaker built around a gas discharge device, wherein a cathode is formed by an end emitter, as well as by a reflector and two coaxial cylinders arranged above the surface of said end emitter, the d.c. breaker further including intermediate electrodes interposed between the cathode and anode, the d.c. breaker being characterized, according to the invention, in that the reflector is cone-shaped and so arranged with respect to the cylinders that the cone's apex faces the end emitter, and in that the angle of inclination of the cone's generatrix is selected so that a normal drawn at any point of the cone's lateral surface intersects the surface of the outer cylinder without intersecting the surfaces of the inner cylinder and the emitter.

In this device, the gas density is reduced by increasing the length of the free path of electrons and accounts for a more uniform scattering of the virgin flow of electrons emitted by the hot cathode's emitter, as well as for a more uniform accumulation of oscillating electrons over the entire spacing defined by the reflector and coaxial cylinders.

The d.c. breaker according to the invention provides for a uniform current load over the cathode surface, which, in turn, makes it possible to break heavier currents.

It is preferable that both cylinders, as well as the reflector and intermediate electrodes, should be manufactured from a material having a sorptive capacity with respect to the gas filling the gas discharge device, at which the gas pressure in the device changes from the initial to the critical value over a specified period of time.

This accounts for a constant, or even increased, rate of absorption of gas by the electrodes during the passage of current; the result is an increase in the operating speed of the device.

BRIEF DESCRIPTION OF THE ATTACHED DRAWINGS

Other objects and advantages of the present invention will become more apparent from the following detailed description of preferred embodiments thereof to be read in conjunction with the accompanying drawings, wherein.

DETAILED DESCRIPTION OF THE INVENTION

Figure 2:
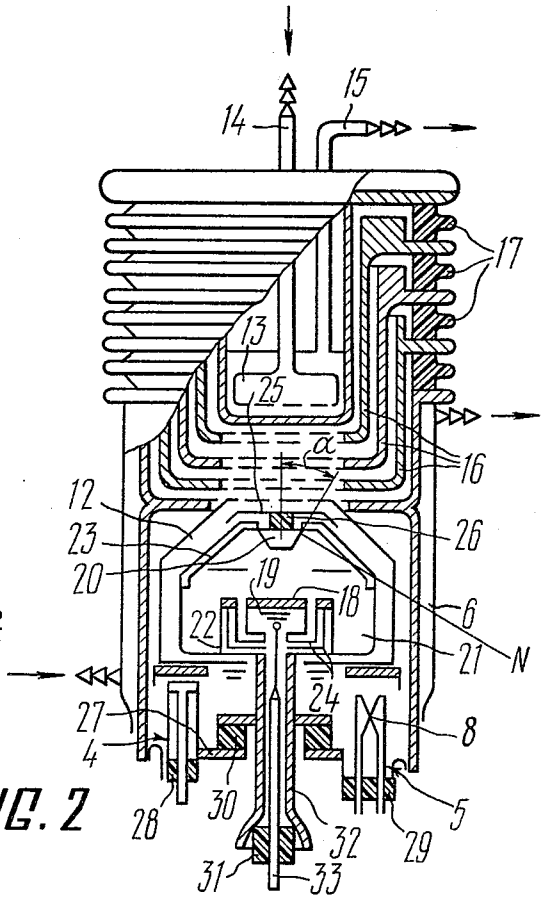
FIG. 2 is a cut-away sectional view of a d.c. breaker in accordance with the invention.

Referring to the accompanying drawings, the proposed d.c. breaker is built around a gas discharge device 1 (FIG. 1) placed in parallel with a load 2 connected via an energy storage reactor 3 to a d.c. source (not shown) supplying direct current at a voltage of $U_o$. The gas discharge device 1 is provided with a generator 4 of gas, specifically, of hydrogen, and with a thermocouple-type gas pressure gauge 5. The gas generator 4 and pressure gauge 5 are built into a housing 6 of the device 1. The gas generator 4 is connected to a power source 7. The pressure gauge 5 is provided with a measuring element 8 connected to a vacuum gauge 9 which, in its turn, is connected to an input of a comparison circuit 10 whose other input is connected to a grid control unit 11 interacting with a grid 12 of the device 1.

The housing 6 of the gas discharge device 1 (FIG. 2) accomodates an anode 13 cooled by a liquid coolant supplied through branch pipes 14 and 15. The housing 6 further accomodates a cathode and intermediate electrodes 16 interposed between said anode 13 and said cathode. The intermediate electrodes 16 are high-voltage dividing inserts insulated from one another and from the housing 6 by ceramic insulators 17. The intermediate electrodes 16 are meant to increase the electric strength of the anode-grid space of the device 1.

The cathode is arranged right under the grid 12 and formed by an end emitter 18 of $LaB_6$, heated by a cone-shaped graphite heater 19, as well as by a cone-shaped reflector 20 and two coaxial cylinders 21 and 22 arranged between the emitter 18 and the reflector 20. The latter is secured above the emitter 18 and rests on four wire holders 23 so that its apex faces the emitter 18. The angle $\alpha$ of inclination of the generatrix of the cone of the reflector 20 is selected so that the normal N drawn through any point of the cone's lateral surface intersects the surface of the outer cylinder 21 without intersecting the surfaces of the inner cylinder 22 and the emitter 18.

Heat filters 24 are arranged between the emitter 18 and the inner cylinder 22.

The base of the reflector 20, facing the anode 13, is protected by a metal screen 25 which rests on a ceramic insulator 26.

The housing 6 is a cooled metal housing; the gas generator 4 and the gas pressure gauge 5 are built into its bottom 27 with the use of leaktight metal-ceramic inlets 28 and 29. The generator 4 is a cylinder of thin titanium foil.

Extending through the bottom 27 are insulators 30 and 31, wherein there are secured leads 32 of the cathode and leads 33 of the heater 19.

The coaxial cylinders 21 and 22, the reflector 20, the holders 23 and the intermediate electrodes 16 are manufactured from titanium with its maximum sorptive capacity with respect to hydrogen. These components may be manufactured from a different material, but the sorptive capacity of this material with respect to the gas filling the device 1 must be such as to change the gas pressure inside the device 1 from an initial value to a critical value over a specified length of time.

The d.c. breaker of the present invention operates as follows.

The heater 19 and pressure gauge 5 are energized. Voltage, which is negative with respect to the lead 32, is applied to the grid 12. Positive d.c. voltage, supplied by the d.c. source, is applied to the anode 13. Pulse current is passed through the gas generator 4; as a result, the pressure in the device 1 rapidly increases and when it reaches a specified level, a positive voltage pulse is applied to the grid 12. There is a flow of current through the device 1, which is accompanied by a rapid decrease in the gas pressure and a breaking of the current.

Whenever it is necessary to prolong or reduce the time interval between the onset and breaking of current, an initiating pulse is applied to the grid 12 with a specified initial pressure value.

Figure 3:
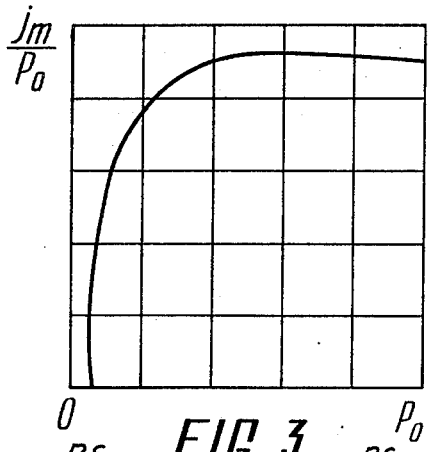
FIG. 3 is a graph showing the critical current density versus the initial gas pressure in the discharge chamber of the gas discharge device (expressed in conventional units)

According to the invention, the method for breaking direct current, effected with the use of the foregoing d.c. breaker, is as follows. First, there is set an initial pressure corresponding to the working conditions of the stationary current channel. The initial pressure level is selected so that the ratio between the maximum current density $j_m$ in the positive gas discharge column and the initial pressure $P_o$ is below the curve presented in FIG. 3. This curve is plotted for hydrogen-filled gas discharge devices. An increase in the current density $j_k$ at any point of the current channel above the value determined by the curve of FIG. 3 leads to a situation when the current channel moves at a high speed across the cavity of the device 1.

Figure 4:
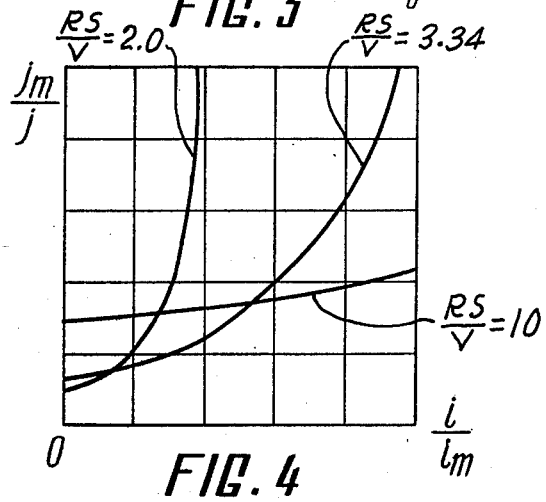
FIG. 4 is a graph showing the maximum current density versus the mean current density in a current channel of a cylindrical shape, and the ratio between the discharge current passed through a gas discharge device filled with hydrogen and the characteristic current (expressed in conventional units)
Figure 5:
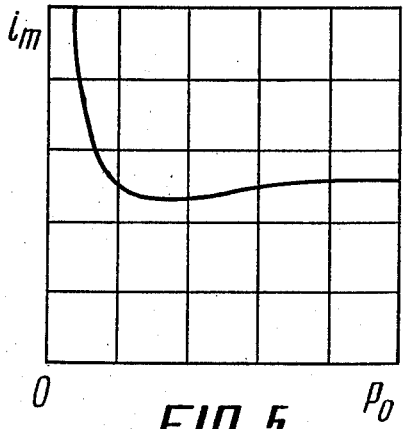
FIG. 5 is a graph showing the characteristic current versus the gas pressure in the gas discharge device (expressed in conventional units).

However, in actual operating conditions, the current channel is compressed by proper magnetic fields, so the discharge chamber of the device 1 is not uniformly filled with current. FIG. 4 presents the relationship between the maximum current density $j_m$ and the mean current density $\bar{j}$ in a cylinder-shaped current channel versus the relationship between the discharge current i and the magnitude of current $i_m$ which is indicative of the degree of compression of the current channel by the proper magnetic fields. FIG. 5 shows the current $i_m$, which is indicative of the degree of compression of the current channel, versus the pressure P.

Upon setting the initial gas pressure, current that has to be broken is passed through the device 1. This is accompanied by a decrease of the gas pressure in the current channel due to the absorption of gas by the intermediate electrodes.

According to the relationship of FIG. 5, the current $i_m$ increases. As is clear from FIG. 4, this accounts for a more uniform distribution of current in the discharge chamber. Thus, after an initial gas pressure, corresponding to the working conditions of the stationary current channel, is set, a subsequent decrease in the density of gas in the current channel results in a uniform distribution of current in the discharge chamber.

The curves in FIG. 4 have been calculated for a cylindrical column of circular shape, where R is the external radius of the chamber, V is the volume of the discharge chamber, and S is the sum surface of the intermediate electrodes filling the chamber and being in contact with the plasma of the gas discharge. The calculation corresponds to the case of a hydrogen-filled chamber.

If the density of gas is reduced in a device with a movable current channel, this increases the speed of motion of the current channel, while maintaining the non-uniformity of current density distribution over the section of the current channel.

The density of gas is reduced with due regard for the actual gas absorption rate from the initial gas pressure to a critical value to cause a breaking of direct current in the device 1. This is accompanied by a simultaneous increase in the current and voltage across the load 2.

Figure 1:
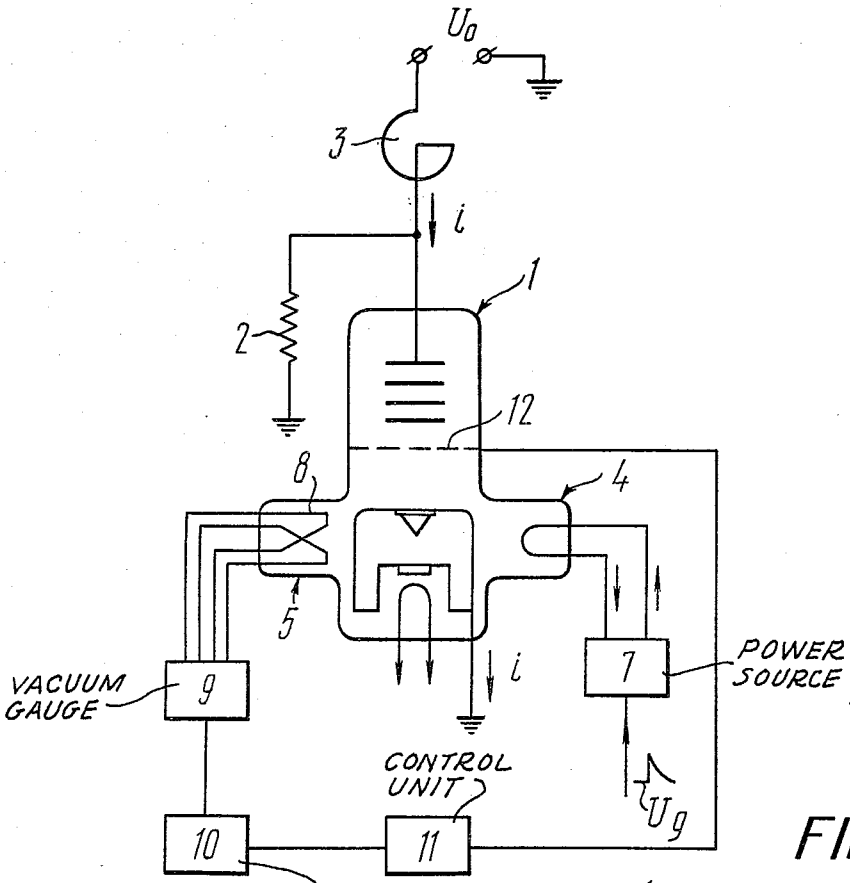
FIG. 1 is a schematic diagram of a d.c. breaker in accordance with the invention.

Referring to FIG. 1, these operations are performed as follows.

The initial gas pressure is set with the aid of the generator 4 and the gas pressure gauge 5. For this purpose, the generator 4 is heated by actuating the power source (not shown) of said gas generator 4 by a pulse $U_g$. This leads to an increase in the gas pressure inside the device 1. A signal corresponding to the gas pressure is applied to the input of the comparison circuit 10 which compares it to reference voltage corresponding to a specified pressure level. If the two pressures are equal, the grid control unit 11 is brought into play and produces an initiating pulse at its output, which is applied to the grid 12 of the device 1. As a result, there is an increase in the current through the reactor 3—device 1 circuit, which is accompanied by a decrease in the gas pressure in the discharge chamber of the device 1 due to the absorption of gas by the electrodes. With the gas density reaching a critical value, the current is broken as soon as the current value in the energy storage reactor 3 reaches a predetermined point.

The method and d.c. breaker in accordance with the invention allow of a considerable increase in the permissible level and rate of increase in the voltage because the gap between the anode and cathode is totally non-conducting by the instant the direct current becomes zero. A change in the density of gas, whereby the current is broken, is effected precisely by that current, which accounts for a reduced power consumption.

The intensity of current to be broken is only dependent upon the configuration of the gas discharge device and is independent of the magnitude of and rate of increase in the return voltage.

What is claimed is:

1. A method for breaking direct current in a gas discharge device comprising:

(a) setting initial gas pressure level so that ratio of maximum current density in a positive gas discharge column to said initial pressure is below a critical value when a current channel moves at a high speed across a cavity of said device;

(b) passing the direct current through said device;

(c) decreasing said gas pressure in said current channel due to absorption of gas by intermediate electrodes in said device;

(d) decreasing subsequently the density of gas in the current channel resulting in uniform distribution of said current in the discharge chamber; and (e) increasing the current and voltage simultaneously across load to reach a predetermined point where it causes to break said current.

2. A method for breaking direct current as recited in claim 1 including the step of setting the intensity of the current so that the current is only dependent upon a configuration of the gas discharge device and is independent of the magnitude and rate of increase in the return voltage.

* * * * *